US006007893A

United States Patent [19]

Merkel et al.

[11] Patent Number: 6,007,893

[45] Date of Patent: Dec. 28, 1999

[54] TEXTILE LATEX

[75] Inventors: Michael P. Merkel, Raleigh; David E. Stark, Chapel Hill, both of N.C.

[73] Assignee: Reichhold Chemicals, Inc., Durham, N.C.

[21] Appl. No.: 08/861,960

[22] Filed: May 22, 1997

Related U.S. Application Data

[63] Continuation of application No. 08/583,416, Jan. 5, 1996, abandoned.

[51] Int. Cl.[6] ..... B32B 3/02

[52] U.S. Cl. ..... 428/96; 428/95; 524/507; 524/812

[58] Field of Search ..... 524/812, 507; 428/96, 95

[56] References Cited

U.S. PATENT DOCUMENTS

| | | | |
|---|---|---|---|
| 3,505,156 | 4/1970 | Handscomb et al. | 161/67 |
| 3,695,987 | 10/1972 | Wisotzky et al. | 161/67 |
| 3,840,489 | 10/1974 | Strazdins | 260/29.6 TA |
| 3,875,097 | 4/1975 | Sedlak | 260/29.4 UA |
| 3,882,070 | 5/1975 | Ceska | 260/29.7 T |
| 4,094,841 | 6/1978 | Mani | 260/29.6 H |
| 4,109,039 | 8/1978 | McCoy | 428/95 |
| 4,191,676 | 3/1980 | Hall | 260/29.7 R |
| 4,439,574 | 3/1984 | Schuppiser et al. | 524/458 |
| 4,440,896 | 4/1984 | Schuppiser et al. | 524/458 |
| 4,595,617 | 6/1986 | Bogdany | 428/95 |
| 4,613,650 | 9/1986 | Sekiya et al. | 524/828 |
| 4,698,384 | 10/1987 | Mao et al. | 428/95 |
| 4,808,660 | 2/1989 | Schmeing et al. | 524/812 |
| 4,876,293 | 10/1989 | Durney et al. | 523/122 |
| 5,093,449 | 3/1992 | Cronin et al. | 526/318 |
| 5,171,768 | 12/1992 | Prentice et al. | 523/348 |
| 5,395,877 | 3/1995 | Pucknat et al. | 524/460 |
| 5,403,640 | 4/1995 | Krishnan et al. | 428/96 |
| 5,444,118 | 8/1995 | Tsuruoka et al. | 524/828 |
| 5,478,641 | 12/1995 | Schmeing et al. | 428/507 |

FOREIGN PATENT DOCUMENTS

| | | |
|---|---|---|
| 0234794A1 | 2/1987 | European Pat. Off. . |
| 0 226 459 | 6/1987 | European Pat. Off. . |
| 0 250 184 A3 | 12/1987 | European Pat. Off. . |
| 0 496 925 A1 | 8/1992 | European Pat. Off. . |

OTHER PUBLICATIONS

Chemical Abstracts, vol. 113, No. 16 (Oct. 15, 1990), abstract No. 134360c, p. 116.

*Primary Examiner*—Helen L. Pezzuto
*Attorney, Agent, or Firm*—Myers Bigel Sibley & Sajovec, P.A.

[57] ABSTRACT

A textile coating composition which has a fast drying rate is disclosed. The coating composition comprises an aryl vinyl monomer, an aliphatic conjugated diene monomer, and an acrylamide-based monomer. The coating composition exhibits a Complete Drying Temperature of less than about 140° C.

18 Claims, No Drawings

TEXTILE LATEX

This application is a continuation of application Ser. No. 08/583,416, filed Jan. 5, 1996 now abandoned.

FIELD AND BACKGROUND OF THE INVENTION

This invention relates to a latex suitable for coating a textile substrate. More specifically, the invention relates to a latex which exhibits an improved drying rate subsequent to application to the textile substrate.

Various tuft-lock coatings, carpet-backing adhesives and non-woven binder compositions for textile substrates are known. For example, U.S. Pat. Nos. 3,505,156 to Handscomb et al.; 3,695,987 to Wisotzsky; 4,595,617 to Bogdany; 4,808,459 to Smith; and 5,403,640 to Krishnan et al. propose employing several latexes for use as tuft-lock coatings. Recent efforts have focused on providing textile coating compositions which have improved bonding strength so as to impart enhanced mechanical properties to the textile article. In particular, U.S. Pat. No. 5,093,449 to Durney-Cronin et al. proposes a polymer emulsion of styrene-butadiene along with a monoester of maleic acid or fumaric acid. Additionally, U.S. Pat. No. 5,444,118 to Tsuruoka et al. proposes a copolymer latex which comprises a conjugated diene compound, a ethylenically unsaturated carboxylic acid, and a chain transfer agent which may be selected from various hydrocarbon components.

In addition to providing a textile with enhanced strength properties, there remains a need in the art to improve production rates of various textiles including carpet. In particular, the drying rate of the latex coating after it has been applied to a carpet backing has been found to directly impact carpet production rates. Accordingly, it would be advantageous to improve drying rates of the latex coating while achieving enhanced strength properties of the coated textile article.

Therefore, it is an object of the present invention to provide a textile latex coating composition which displays an improved rate of drying after application to a textile substrate.

It is a further object of the present invention to provide a textile latex coating which imparts improved strength properties to the textile substrate.

SUMMARY OF THE INVENTION

To these ends, the present invention provides a textile coating composition which has a fast drying rate and comprises an aryl vinyl monomer, an aliphatic conjugated diene monomer, and an acrylamide-based monomer. As described in greater detail herein, the coating composition exhibits a Complete Drying Temperature (hereinafter "CDT") of less than about 140° C.

In one embodiment, the acrylamide-based monomer may be selected from acrylamide, N-methyolacrylamide, N-methyolmethacrylamide, methacrylamide, N-isopropylacrylamide, N-tert-butylacrylamide, N-N'-methylene-bisacrylamide, and blends and mixtures thereof.

In a preferred embodiment, the aryl vinyl monomer is styrene and the aliphatic conjugated diene monomer is 1,3-butadiene.

The textile coating composition may comprise other additional monomers. In one embodiment, the composition further comprises a non-aromatic unsaturated mono- or dicarboxylic ester monomer. In another embodiment, the composition further comprises an unsaturated mono- or dicarboxylic acid monomer.

The textile coating composition may also comprise a surfactant. For the purposes of the invention, the coating composition preferably comprises no greater than 0.3 weight percent of surfactant.

The invention also provides a pile carpet. The pile carpet comprises a primary backing and pile yarns extending from the front of the primary backing to form pile tufts. The pile yarns have portions extending through the primary backing to the rear of the primary backing. A tuft-lock coating is carried by the rear of the primary backing and secures the pile yarns to the primary backing. The tuft-lock coating is a polymer having a fast drying rate, the polymer comprising an aryl vinyl monomer, an aliphatic conjugated diene monomer, and an acrylamide-based monomer. The polymer exhibits a CDT of less than about 140° C.

DETAILED DESCRIPTION OF THE INVENTION

As summarized above the present invention relates to a polymeric textile coating composition and a textile substrate (e.g., pile carpet) which is coated by the composition.

The textile substrate may be coated with the coating by impregnating, padding or otherwise applying the coating to a surface of the textile substrate followed by heating the substrate to dry the coating. For purposes of this invention, the term "textile substrate" relates to a fiber, web, yarn, thread, sliver, woven fabric, knitted fabric, non-woven fabric, upholstery fabric, tufted carpet, pile carpet, etc. formed from natural and/or synthetic fibers. A particularly suitable textile substrate is a tufted carpet. Tufted carpet typically comprises a primary backing and pile yarns extending from the backing. The pile yarns can be cut to form tufts or can be looped to form a loop pile. The pile yarns are bonded to the primary backing using a coating sometimes referred to as a "tuft-lock" coating. The tufted carpet can be a unitary carpet or can include a secondary backing bonded to the primary backing. The secondary backing can be formed from natural fibers (e.g. jute), or synthetic fibers (e.g., polypropylene), and can be woven or non-woven materials. The secondary backing can also be a foam composition comprised of urethane polymers. The secondary backing can be bonded to the primary backing using the thermoplastic adhesive properties of the coating composition.

Another suitable textile substrate is a needled non-woven fabric formed from various natural and synthetic fibers such as described in U.S. Pat. No. 4,673,616 to Goodwin, the disclosure of which is incorporated herein by reference. The polymeric coating can be used to stiffen or rigidify the needled non-woven fabric to permit the fabric to be formed into a three-dimensional shape (i.e., it is moldable).

The textile coating composition of the present invention comprises an aryl vinyl monomer, an aliphatic conjugated diene monomer, and an acrylamide-based monomer. In accordance with the invention, the coating composition exhibits a fast drying rate. For the purposes of the invention, the term "fast drying rate" refers to the coating composition exhibiting a CDT of less than about 140° C. during any known and appropriate thermogravimetric analysis procedure. More preferably, the CDT of the coating composition is less than about 130° C., and most preferably less than about 120° C. The CDT of the coating composition represents the temperature at which the sample is completely dry, i.e., exhibits constant weight during the test procedure. The CDT is typically determined by the onset point of the sample which may be calculated using a suitable technique. Preferably, a Perkin Elmer® TGA 7 Thermogravimetric Analyzer is used for determining the CDT of textile coating composition. When utilizing this equipment, the onset point is calculated using the computer software package described in the Instrument Manual for the above Perkin Elmer® analyzer.

Suitable aryl vinyl monomers which may be employed in the coating composition include, for example, styrene and styrene derivatives such as alpha-methyl styrene, p-methyl styrene, vinyl toluene, ethylstyrene, tert-butyl styrene, monochlorostyrene, dichlorostyrene, vinyl benzyl chloride, fluorostyrene, alkoxystyrenes (e.g., paramethoxystyrene), and the like, along with blends and mixtures thereof. The aryl vinyl monomer may be used in an amount, based on the total weight of the starting monomers, from about 10 to 90 percent by weight, preferably from about 50 to 70 percent by weight, and most preferably from about 60 to 65 percent by weight. A particularly preferred aryl vinyl monomer is styrene.

Suitable aliphatic conjugated dienes are $C_4$ to $C_9$ dienes and include, for example, butadiene monomers such as 1,3-butadiene, 2-methyl-1,3-butadiene, 2 chloro-1,3-butadiene, and the like. Blends or copolymers of the diene monomers can also be used. The aliphatic conjugated diene may be used in an amount, based on the total weight of the starting monomers, from about 10 to 90 percent by weight, preferably from about 20 to 50 percent by weight, and most preferably from about 30 to 35 percent by weight. A particularly preferred aliphatic conjugated diene is 1,3-butadiene.

The acrylamide-based monomer which may be employed in the coating composition may include, for example, acrylamide, N-methyolacrylamide, N-methyolmethacrylamide, methacrylamide, N-isopropylacrylamide, N-tert-butylacrylamide, N-N'-methylene-bis-acrylamide, alkylated N-methylolacrylamides such as N-methoxymethylacrylamide and N-butoxymethylacrylamide, and blends and mixtures of the above. The acrylamide-based monomer may be used in an amount, based on the total weight of the starting monomers, from about 0.1 to 5 percent by weight, preferably from about 0.2 to 3 percent by weight, and most preferably from about 0.5 to 2 percent by weight.

Suitable non-aromatic unsaturated monocarboxylic ester monomers may be added to the textile coating composition and include, for example, acrylates and methacrylates. The acrylates and methacrylates may include functional groups such as amino groups, hydroxy groups, epoxy groups and the like. Exemplary acrylates and methacrylates include methyl acrylate, methyl methacrylate, ethyl acrylate, ethyl methacrylate, butyl acrylate, butyl methacrylate, 2-ethylhexyl acrylate, glycidyl acrylate, glycidyl methacrylate, hydroxyethyl acrylate, hydroxyethyl methacrylate, hydroxypropyl acrylate, hydroxypropyl methacrylate, isobutyl methacrylate, hydroxybutyl acrylate, hydroxybutyl methacrylate, 3-chloro-2-hydroxybutyl methacrylate, n-propyl methacrylate and the like. Exemplary amino-functional methacrylates include t-butylamino ethyl methacrylate and dimethylamino ethyl methacrylate. Suitable non-aromatic dicarboxylic ester monomers are alkyl and dialkyl fumarates, itaconates and maleates, with the alkyl group having one to eight carbons, with or without functional groups. Specific monomers include diethyl and dimethyl fumarates, itaconates and maleates. Other suitable non-aromatic dicarboxylic ester monomers include di(ethylene glycol) maleate, di(ethylene glycol) itaconate, bis(2-hydroxyethyl) maleate, 2-hydroxyethyl methyl fumarate, and the like.

The mono and dicarboxylic acid esters monomers may be blended or copolymerized with each other. For example, when the desired polymer includes an ester of a dicarboxylic acid monomer, it is preferable to form the polymer by copolymerizing the dicarboxylic ester monomer with an ester of a monocarboxylic acid monomer. Graft polymerization can also be used.

The non-aromatic unsaturated mono- or dicarboxylic ester monomer may be used in any appropriate amount for the purposes of the invention. Preferably, the monomer from about 50 to 70 percent based on the total weight of the starting monomers, and most preferably from about 60 to 65 percent by weight. A particularly preferred non-aromatic unsaturated monocarboxylic ester monomer is methyl methacrylate.

Suitable monomers based on the half ester of the unsaturated dicarboxylic acid monomer may also be added to the latex polymer and include mono esters of maleic acid or fumaric acid having the formula ROOC—CH═CH—COOH wherein R is a $C_1$ to $C_{12}$ alkyl group, for example monomethyl maleate, monobutyl maleate and monooctyl maleate. Half esters of itaconic acid having $C_1$ to $C_{12}$ alkyl groups such as monomethyl itaconate can also be used. Blends or copolymers of the unsaturated mono- or dicarboxylic acid monomers and of the half ester of the unsaturated dicarboxylic acid can also be used.

The unsaturated mono- or dicarboxylic acid monomer based on the half ester of the unsaturated dicarboxylic acid is preferably used in an amount, based on the total weight of the starting monomers, from about 0 to 5 percent by weight and more preferably from about 1 to 2 percent by weight.

Unsaturated mono- or dicarboxylic acid monomers and derivatives thereof may also be employed and include components such as acrylic acid, methacrylic acid, itaconic acid, fumaric acid, and maleic acid, and the like. The unsaturated mono- or dicarboxylic acid monomers and derivatives thereof may be used in an amount, based on the total weight of the starting monomers, from about 0 to 5 percent by weight, and more preferably from about 1 to 2 percent by weight.

Additional comonomers can be added to the textile coating composition. Included among such additional comonomers are monoethylenically unsaturated substituted aliphatic hydrocarbons such as vinyl chloride, and vinylidene chloride; and aliphatic vinyl esters such as vinyl formate, vinyl propionate and vinyl butyrate. Acrylonitrile may also be employed.

In accordance with the invention, conventional surfactants can also be employed in an amount such that the resulting coating composition preferably has a surfactant content of less than 1.0 weight percent, more preferably less than 0.5 weight percent, and most preferably less than 0.2 weight percent. In accordance with the invention, the specific surfactant content levels are believed to impart a desirable level of moisture resistance to the textile coating composition. Any of the anionic or nonionic surfactants may be employed for the purposes of the invention. Polymerizable surfactants that can be incorporated into the polymer also can be used. Nonionic surfactants can include suitable alkyl esters, alkyl phenyl ethers, and alkyl ethers of polyethylene glycol. Exemplary nonionic surfactants are selected from the family of alkylphenoxypoly (ethyleneoxy) ethanols where the alkyl group typically varies from $C_7$–$C_{18}$ and the ethylene oxide units vary from 4–100 moles. Various preferred surfactants in this class include the ethoxylated octyl and nonyl phenols, and in particular ethoxylated nonyl phenols with a hydrophobic/lipophilic balance (HLB) of 15–19. Anionic surfactants are preferred for the purposes of the invention and can be selected, for example, from the broad class of sulfonates, sulfates, ethersulfates, sulfosuccinates, diphenyloxide disulfonates, and the like, and are readily apparent to anyone skilled in the art. More particularly, the anionic surfactants can include a salt of an alcohol sulfate (e.g., sodium lauryl sulfate); a salt of an alkylbenzenesulfonic acid (e.g., sodium dodecylbenzenesulfonate); and a sulfonic acid salt of an aliphatic carboxylic acid ester (e.g., sodium dioctylsulfosuccinate). A preferred anionic surfactant is sodium dodecyl benzene sulfonate.

The polymer can include crosslinking agents and other additives to improve various physical and mechanical properties of the polymer, the selection of which will be readily apparent to one skilled in the art. Exemplary crosslinking agents include vinylic compounds (e.g., divinyl benzene); allyllic compounds (e.g., allyl methacrylate, diallyl maleate); and multifunctional acrylates (e.g., di, tri and tetra (meth)acrylates). The crosslinking agents can be included in amounts of up to about 7 percent by weight, and preferably about 0.05 to 5 percent by weight. Additional monomers can be included to improve specific properties such as solvent resistance (e.g., nitrile-containing monomers such as acrylonitrile and methacrylonitrile) and adhesion and strength (e.g., use of acrylamide or methacrylamide).

An initiator which facilitates polymerization may include, for example, materials such as persulfates, organic peroxides, peresters, and azo compounds such as azobis (isobutyronitrile) (AIBN). Common initiators include those such as, for example, cumene hydroperoxide, dicumylperoxide, diisopropylbenzene hydroperoxide, and tert butyl hydroperoxide. Preferred initiators are persulfate initiators such as, for example, ammonium persulfate and potassium persulfate. Ammonium persulfate is the preferred initiator. Preferably, the amount of initiator ranges from about 0.1 percent to about 1 percent based on the weight of the total monomer. More preferably, the initiator ranges from 0.2 percent to about 0.4 percent.

Reductants may be employed in the polymerization, and are typically employed in combination with the initiator as part of a redox system. Suitable reductants include sodium bisulfite, erythorbic acid, ascorbic acid, sodium thiosulfate, sodium formaldehyde sulfoxylate (SFS), and the like.

Other additives include other natural and synthetic binders, fixing agents, wetting agents, plasticizers (e.g., diisodecyl phthalate), softeners, foam-inhibiting agents, froth aids, other crosslinking agents (e.g., melamine formaldehyde resin), pH adjusting agents (e.g., ammonium hydroxide) flame retardants, catalysts (e.g., diammonium phosphate or ammonium sulfate), dispersing agents, chelating agents, chain transfer agents, etc., the selection of which will be readily apparent to one skilled in the art.

The textile coating composition may be prepared by any of the suitable emulsion polymerization processes, including batch and semi-continuous processes. The components which are utilized in the processes are added according to known and accepted techniques. Subsequent to the polymerization taking place, a stripping step may be carried out to remove unreacted monomers and other components which may be present. Any suitable and known technique may be used to carry out the stripping step including the use of steam (i.e., steam stripping) alone or in combination with a redox system (i.e., chemical stripping).

The present invention and its advantages over the prior art will be more fully understood and appreciated from the illustrative examples which follow. It is to be understood that the examples are for the purpose of illustration and are not intended as being limiting upon the scope of the invention. A person skilled in the applicable arts will appreciate from these examples that this invention can be embodied in many different forms other than as is specifically disclosed.

COMPARATIVE EXAMPLES 1–5

The CDT of five prior art textile coating compositions was determined. The coating compositions were compounded so as to comprise one part of latex and four parts of inorganic filler. In each test, a sample size of 50 mg each was weighed out and loaded into a Perkin Elmer TGA 7, Thermogravimetric Analyzer. The initial temperature was 30° C. and each sample was heated at a rate of 10° C./min. until a temperature of 250° C. was reached. The solids content of the coating composition was adjusted to 78 weight percent in each instance. The tests were conducted utilizing standard procedure expressed in the Perkin Elmer TGA 7 Instruction Manual. The CDT was determined using the computer software package by calculating the onset point as described in the above instruction manual. The onset point represents the temperature at which the sample is completely dry, i.e., exhibits constant weight. The CDTs of the comparative examples are listed in Table 1.

EXAMPLES 6–8

The procedure described above is carried out for three samples having the above latex-to-filler ratio only utilizing the coating composition of the present invention. The CDTs of the samples are listed in Table 1.

TABLE I

CDT Determined On the TGA

| Latex System | CDT, ° C. |
|---|---|
| Comparative Example 1 | 144 |
| Comparative Example 2 | 147 |
| Comparative Example 3 | 148 |
| Comparative Example 4 | 154 |
| Comparative Example 5 | 155 |
| Example 6 | 121 |
| Example 7 | 132 |
| Example 8 | 137 |

As shown, the CDTs of Examples 6–8 are lower than the comparative examples. As such, less energy is needed when drying the coatings during manufacturing.

In the specification, there have been disclosed preferred embodiments of the invention and, although specific terms are employed, they are used in a generic and descriptive sense only and not for the purpose of limitation, the scope of the invention being set forth in the following claims.

That which is claimed is:

1. A textile coating composition having a fast drying rate consisting essentially of an aryl vinyl monomer, an aliphatic conjugated diene monomer, an acrylamide-based monomer selected from the group consisting of acrylamide, methacrylamide, N-isopropylacrylamide, N-tert-butylacrylamide, N-N'-methylene-bisacrylamide, blends thereof, and mixtures thereof, and a surfactant, wherein said coating composition exhibits a CDT of less than about 140° C. and having no greater than 0.5 weight percent of said surfactant.

2. A textile coating composition according to claim 1 wherein the aryl vinyl monomer is styrene and the aliphatic conjugated diene monomer is 1,3-butadiene.

3. A textile coating composition according to claim 1 comprising from 10 to 90 percent by weight of the aryl vinyl monomer.

4. A textile coating composition according to claim 1 comprising from 10 to 90 percent by weight of the aliphatic conjugated diene monomer.

5. A textile coating composition according to claim 1 comprising from 0.1 to 5 percent by weight of the acrylamide-based monomer.

6. A textile coating composition according to claim 1 further comprising a non-aromatic unsaturated mono- or dicarboxylic ester monomer.

7. A textile coating composition according to claim 1 further comprising an unsaturated mono- or dicarboxylic acid monomer.

8. A textile coating composition having a fast drying rate consisting essentially of from 10 to 90 weight percent of an aryl vinyl monomer, 10 to 90 weight percent of an aliphatic conjugated diene monomer, 0.1 to 5 weight percent of an acrylamide-based monomer selected from the group consisting of acrylamide, methacrylamide, N-isopropylacrylamide, N-tert-butylacrylamide, N-N'-methylene-bisacrylamide, blends thereof, and mixtures thereof, and a surfactant, wherein said coating composition exhibits a CDT of less than about 140° C. and having no greater than 0.5 weight percent of said surfactant.

9. A textile coating composition according to claim 8 wherein the aryl vinyl monomer is styrene and the aliphatic conjugated diene monomer is 1,3-butadiene.

10. A textile coating composition according to claim 8 further comprising a non-aromatic unsaturated mono- or dicarboxylic ester monomer.

11. A textile coating composition according to claim 8 further comprising an unsaturated mono- or dicarboxylic acid monomer.

12. A pile carpet comprising:

(a) a primary backing;

(b) pile yarns extending from the front of the primary backing to form pile tufts, and having portions extending through the primary backing to the rear thereof; and (c) a tuft-lock coating carrier by the rear of the primary backing and securing the pile yarns to the primary backing, the tuft-lock coating being a polymer having a fast drying rate consisting essentially of an aryl vinyl monomer, an aliphatic conjugated diene monomer, an acrylamide-based monomer selected from the group consisting of acrylamide, methacrylamide, N-isopropylacrylamide, N-tert-butylacrylamide, N-N'-methylene-bisacrylamide, blends thereof, and mixtures thereof, and a surfactant, wherein said polymer exhibits a CDT of less than about 140° C. and having no greater than 0.5 weight percent of the surfactant, and wherein said polymer is in a completely dried state.

13. A pile carpet according to claim 12 wherein the aryl vinyl monomer is styrene and the aliphatic conjugated diene monomer is 1,3-butadiene.

14. A pile carpet according to claim 12 comprising from 10 to 90 percent by weight of the aryl vinyl monomer.

15. A pile carpet according to claim 12 comprising from 10 to 90 percent by weight of the aliphatic conjugated diene monomer.

16. A pile carpet composition according to claim 12 comprising from 0.1 to 5 percent by weight of the acrylamide-based monomer.

17. A pile carpet according to claim 12 wherein the polymer further comprises a non-aromatic unsaturated mono- or dicarboxylic ester monomer.

18. A pile carpet according to claim 12 wherein the polymer further comprises an unsaturated mono- or dicarboxylic acid monomer.

* * * * *